US006345739B1

(12) United States Patent
Mekata

(10) Patent No.: US 6,345,739 B1
(45) Date of Patent: Feb. 12, 2002

(54) METHOD FOR PRODUCING A DOUBLE AEROSOL DEVICE AND CONTAINER THEREFOR

(75) Inventor: Satoshi Mekata, Ibraki (JP)

(73) Assignee: Daizo Co., Ltd., Osaka (JP)

( * ) Notice: Subject to any disclaimer, the term of this patent is extended or adjusted under 35 U.S.C. 154(b) by 0 days.

(21) Appl. No.: 09/117,587

(22) PCT Filed: Feb. 2, 1996

(86) PCT No.: PCT/JP96/00245

§ 371 Date: Aug. 3, 1998

§ 102(e) Date: Aug. 3, 1998

(87) PCT Pub. No.: WO97/28068

PCT Pub. Date: Aug. 7, 1997

(51) Int. Cl.[7] ..... B65D 83/60

(52) U.S. Cl. ..... 222/389; 222/386.5; 222/387; 141/3; 141/20; 53/266.1; 53/470

(58) Field of Search ..... 222/386–389; 141/3, 20; 53/266.1, 284.5, 470

(56) References Cited

U.S. PATENT DOCUMENTS

| | | | | | |
|---|---|---|---|---|---|
| 3,099,370 | A | * | 7/1963 | Hein | 222/386.5 |
| 3,961,725 | A | * | 6/1976 | Clark | 222/386.5 |
| 4,867,208 | A | * | 9/1989 | Fitzgerald et al. | 222/386.5 |
| 5,065,900 | A | * | 11/1991 | Scheindel | 222/386 |
| 5,178,300 | A | * | 1/1993 | Haviv et al. | 222/387 |
| 5,179,982 | A | * | 1/1993 | Berube et al. | 141/20 |
| 5,775,549 | A | * | 7/1998 | De Laforcade | 222/389 |
| 5,878,922 | A | * | 3/1999 | Boring | 222/387 |

* cited by examiner

*Primary Examiner*—J. Casimer Jacyna
(74) *Attorney, Agent, or Firm*—McDermott, Will & Emery

(57) ABSTRACT

A process for producing a double dispensing device having a piston (2) functioning a check valve for allowing a gas to move from below to the above the piston, while preventing it from moving from above to below, said process comprising steps of loading a pressurized gas insoluble in a stock solution into a first chamber (N1) to below said piston (2) through a valve (6), allowing said pressurized gas to move into a second chamber (N2) above said piston (process S2), and transferring said pressurized gas in said first chamber (N1) into said second chamber (N2) by similarly loading stock solution into said first chamber (N1) (process S3).

23 Claims, 16 Drawing Sheets

METHOD FOR PRODUCING A DOUBLE AEROSOL DEVICE AND CONTAINER THEREFOR

FIELD OF ART

The present invention relates to a process for producing a double dispensing device like an aerosol device and a container therefor, and more particularly, to a process for producing a double dispensing device characterized in steps of loading stock solution or concentrate and pressurized gas, and to a double dispensing container adapted to the process.

BACKGROUND ART

Generally, as known dispensing devices, there are two types of devices, that is, a general type in which stock solution is loaded into a container together with propellant, and a so called "double dispensing device" in which stock solution is loaded into a container, and the stock solution is separated from the propellant by means of a barrier wall such as a piston or an inner bag such that the stock solution is pressurized by the propellant through the barrier wall. The latter is used for loading liquid food or the like which is not preferable to be blended with propellant, or stock solution which might react with propellant when they are blended with each other. As the barrier, a collapsible inner bag or a piston that is movable up and down in the container is used generally. In some devices in which a piston is used as a barrier wall, the upper chamber is loaded with stock solution, and the lower chamber is loaded with propellant (liquefied gas or compressed gas). In another case, the upper chamber is loaded with a pressurized gas and the lower chamber is loaded with a stock solution. The latter case is reasonable, since the pressurized gas is low in specific gravity. However, such type of device needs a tube extending bellow from a dispensing valve (aerosol valve) through the piston. In this case, the piston moves by sliding along the tube and an inner wall of the container.

Further, when a stock solution and propellant are loaded into a container, stock solution which can be loaded under atmospheric pressure is loaded fore in a general case, and pressurized gas is thereafter loaded through a gas-loading-valve or by so-called under-cup-loading. The gas-loading-valve might be provided in a bottom of the container or a mounting cup of the dispensing valve. However, the gas-loading-valve attached separately provides excess cost, and the loading process is troublesome. For example, the above-mentioned passing through the piston is produced by the following steps. That is to say, a pipe-like nozzle is inserted through a tube-inserting hole of a piston, and a stock solution is loaded below the piston thereby lifting the piston by means of pressure or buoyancy. Then, under an unstable state that the piston lifts on the way, a tube fixed to the dispensing valve is inserted through the tube-inserting hole of the piston. Then, a pressurized gas is loaded with under-cup-loading through a gap between the dispensing valve and an opening of the container, and immediately after the gas-loading, the dispensing valve is crimped, or the pressurized gas is loaded through a gas-loading-valve separately provided on the container. Therefore, some gap is required between the tube-inserting hole and the tube, and the propellant might leak through the gap.

Therefore, in such type of dispensing device that propellant is loaded in the lower side of the piston, a gas-loading-valve is necessary to be provided in the bottom of the container. Therefore, high cost is required, the loading work is troublesome, and production efficiency is low. In addition, there is probability of leak through the propellant-loading-valve.

In a case of double dispensing device using an inner bag, the loading process is troublesome when under-cup-loading is employed. Specifically, when a loading valve is attached at a bottom of container, cost is high, and there is probability of leak of propellant.

Further, when compressed gas is employed as propellant, the gas-leak problem among the above-mentioned problems becomes important especially, since the loaded amount of the pressurized gas depends on the volume and the upper bound of pressure, and the propellant cannot be loaded in excess. That is to say, when compressed gas is used, the device is very sensitive to leak of gas not similar to the case of liquefied gas.

The object of the present invention is to provide a process for producing a double dispensing device which is easily loaded and propellant does not easily leak. Another object of the present invention is to provide a double dispensing container to be used go for the process.

DISCLOSURE OF INVENTION

According to the present invention, there is provided a process for producing a double dispensing device, by providing a pressure-transmittable barrier wall to separate an inside of a vessel (or body of container) into a first chamber and a second chamber, a dispensing valve, a passage to connect the dispensing valve with the first chamber, and a check valve means capable of flowing liquid from the first chamber to the second chamber in a pressure vessel; loading pressurized gas substantially insoluble to stock solution into the first chamber from the valve through the passage, and further bringing the pressurized gas to the second chamber through the check valve means; and loading stock solution into the first chamber through the passage from the valve.

At the step of loading a stock solution from the valve, the gas remaining in the first chamber might be forcibly brought to the second chamber by means of a stock solution loaded into the first chamber. The gas remaining in the first chamber might also be discharged through the valve after the step of loading the gas and before the first chamber is loaded with the stock solution. In the step of loading stock solution in the first chamber, it is preferable to load the stock solution so sufficiently that some stock solution overflow the first chamber to the second chamber.

The double dispensing container of the present invention comprises a pressure vessel; a dispensing valve mounted on a top opening of the vessel; a pressure-transmittable barrier wall for separating an inside of the vessel with airtight manner into a first chamber to be loaded with stock solution and a second chamber to be loaded with pressurized gas; a passage for connecting the valve with the first chamber; and a check valve means for enabling movement of gas from first chamber to the second chamber when pressure in the first chamber is higher than that of the second chamber and for preventing movement of gas from the second chamber to the first chamber when pressure in the second chamber is higher than that of the first chamber. However, it is not necessary to seal perfectly the movement in the reverse direction.

The above-mentioned barrier wall might be a piston which separates the inside of the vessel and is slidable in an up-down direction. The piston might be constructed so as to function as the check valve means for enabling gas movement from the first chamber to the second chamber and for preventing reverse movement. In this case, when the lower side is the first chamber, the above-mentioned passage might be a tube for connecting the valve with the first chamber. When the upper side is the first chamber, the valve might be directly connected with the first chamber.

When the piston functions as a check valve means, it is preferable that the periphery of the piston is yieldable elastically toward inside so that the piston can function as a check valve. Further, a stopper is preferably interposed between the vessel or valve and the piston so as to secure some space for the second chamber with a predetermined volume when the piston moves to decrease the volume of the second chamber. The above-mentioned predetermined volume is preferably 30 to 50% of the volume of the vessel. The stopper can be obtained by an inner face of the vessel or a lower face of the valve to be abutted against the piston.

The above-mentioned barrier wall can be made of a collapsible or deformable inner bag of which inside becomes the first chamber. In this case, the inner bag is preferably provided with a check valve at the bottom of the inner bag or the top of the inner bag or at position near the dispensing valve.

Further, the above-mentioned double dispensing container is preferably provided with a means for forcibly connecting the second chamber with the valve or the first chamber when the barrier wall moves or is deformed to reduce the volume of the first chamber. As the forcibly connecting means for the piston-type-device, a through hole in the tube capable of connecting the inside of the tube with the second chamber, or an element capable deforming or piercing the piston, when the piston moves to reduce the volume of the first chamber, can be employed. As a case of the inner-bag-type, an element to pierce the inner bag to connecting the outer side of the inner bag with the inside of the inner bag or the valve, when the inner bag shrinks, can be employed.

In the case of the above-mentioned piston-type double dispensing container with a tube, a dispensing device can be produced by loading a pressurized gas substantially insoluble to a stock solution into the first chamber from the valve through the tube, and loading a stock solution in the first chamber from the valve through the tube with keeping the container in a right-standing posture to provide motion of the pressurized gas in the first chamber to the second chamber.

In a case of piston-type double dispensing container without a tube, a dispensing device can be produced by loading a pressurized gas substantially insoluble to a stock solution into the first chamber from the valve; and loading a stock solution in the first chamber from the valve with keeping the container in an inverted posture to provide motion of the pressurized gas remaining in the first chamber to the second chamber.

In a case of the inner-bag-type double dispensing container with a check valve at a bottom or top portion, a double dispensing device can be produced by loading a pressurized gas substantially insoluble to stock solution from a valve; and loading a stock solution into the first chamber from the valve with keeping the container in a right standing or inverted posture to provide motion of the pressurized gas remaining in the first chamber toward the second chamber.

In any case of double dispensing containers mentioned above, the pressurized gas in the first chamber might be discharged once after the pressurized gas is loaded, and the stock solution therefore might be loaded into the first chamber.

In the process for producing a double dispensing device of the present invention, not similarly to conventional process, pressurized gas is loaded at first, and stock solution is loaded thereafter. That is to say, when the pressurized gas is loaded into the first chamber from a valve through a passage, such as a tube, at first, the first chamber is filled with the pressurized gas with moving or deforming a barrier wall. Then, the pressurized gas in the first chamber moves to the second chamber through the check valve means. At this situation the pressure in the first chamber is the same as the second chamber. Next, as loading a stock solution into the first chamber from the same valve, the first chamber is filled with the stock solution. During the loading of the stock solution, the pressurized gas do not leak from the second chamber to the first chamber due to the function of the check valve means.

In the process of the present invention, contents can be loaded after the dispensing container has been assembled entirely without employing under-cup-loading. Further, since pressurized gas and stock solution can be loaded from the same valve, any additional gas-loading-valve is not necessary at a bottom of the vessel or the like. Further, loading process is easy, and production efficiency is high. Further, after the loading process, the stock solution in the first chamber is interposed between the pressurized gas in the second chamber and the valve. Therefore, the pressurized gas is in a liquid-sealed condition, and the gas is hard to leak. Therefore, it is convenient to use a compressed gas which is sensitive to leak as propellant.

Beside, at a situation that only pressurized gas is loaded, that is, before the stock solution is loaded, it can be easily confirmed whether there is leak or not.

Among the above-mentioned producing processes, when the process in which the pressurized gas remains in the first chamber and is moved to the second chamber as loading stock solution into the first chamber, is employed, the initial loading pressure of the pressurized gas might be low, and gas-discharging step is not necessary.

In contrast with the above-mentioned, the process in which stock solution is loaded after the pressurized gas in the first chamber is discharged through the valve, has an advantage that the container is not required to stand reversely even if the first chamber is upper side of the vessel. Further, when the pressurized gas is discharged from the first chamber, the pressurized gas is hard to leak from the second chamber to the first chamber by virtue of the function of check valve means.

In the piston-type double dispensing container of the present invention, the pressurized gas can smoothly move from the first chamber to the second chamber since a piston functions as a check valve. Therefore, by loading stock solution into the first chamber with keeping the container in a right stand posture, in which the first chamber to be loaded with stock solution is lower side, or in an inverted posture, only the pressurized gas can be easily loaded into the second chamber through the piston capable of functioning as a check valve. The dispensing container having a stopper for securing a predetermined space at end of stroke of the piston has advantage that the pressurized gas can securely move to the second chamber.

In the inner-bag-type double dispensing device of the present invention, by loading stock solution with the container standing in right or inverted posture in dependent to the position of the check valve, only the pressurized gas can be easily moved to the second chamber through the check valve. Further, in the double dispensing container with means for forcibly connecting, the second chamber is connected with the first chamber or the dispensing valve when the stock solution is used up. Therefore, the pressurized gas remaining in the second chamber can be exhausted outward through the first chamber and the dispensing valve.

Therefore, the interior pressure can be reduced before the container is abandoned, and the container can be safely abandoned.

Hereinafter, referring to the attached drawings, the process for producing a double dispensing device and a double dispensing container used therefor of the present invention will be explained.

BEST MODE FOR CARRYING OUT THE INVENTION

Figure 1:
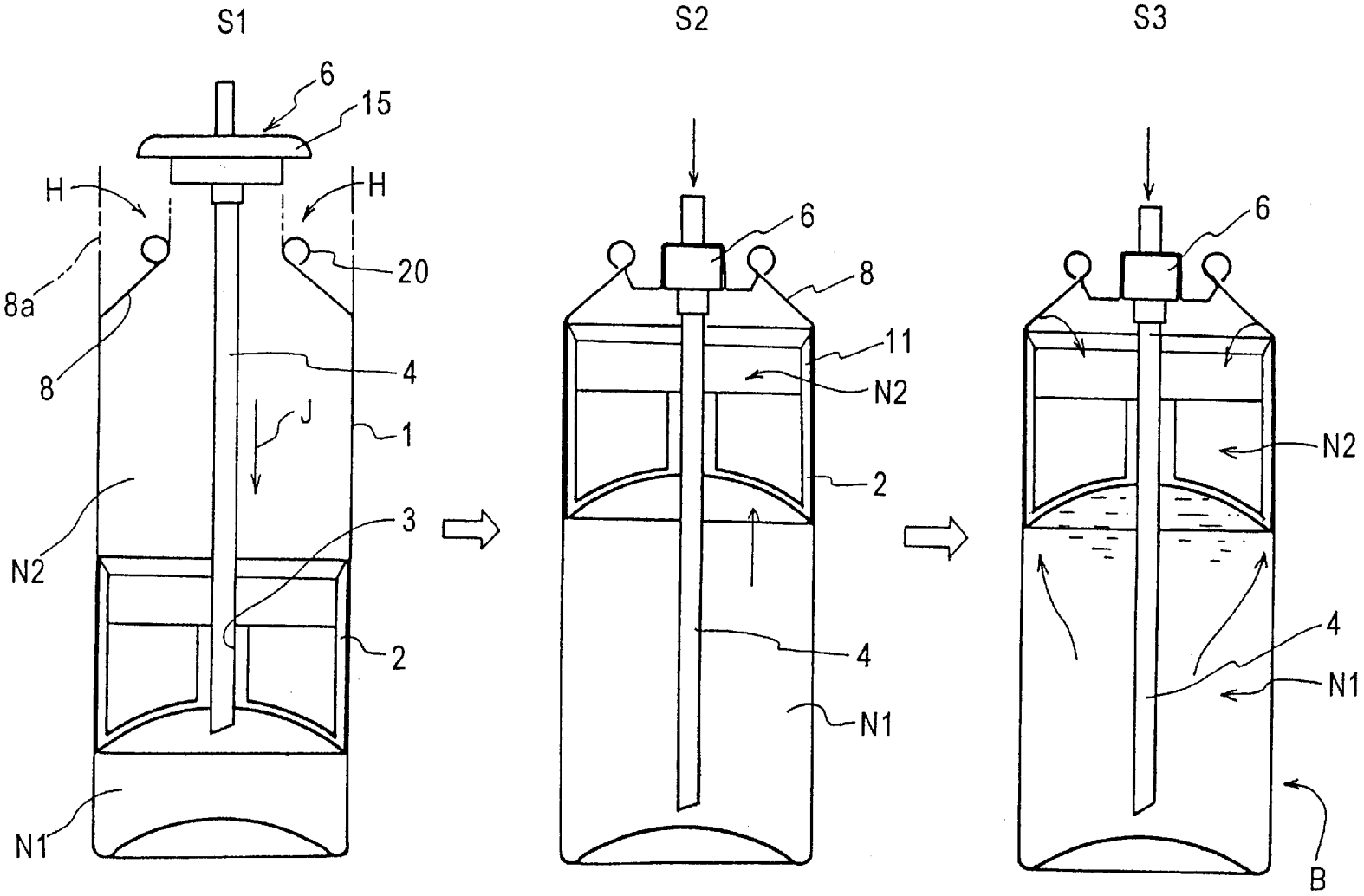
FIG. 1 is a process drawing showing an embodiment of the process for producing a dispensing device of the present invention.

At first, referring to FIG. 2, an embodiment of a dispensing container will be explained. The dispensing container A has a vessel 1, a piston 2 housed therein movably up and down as a barrier wall, a tube 4 inserted in a hole 3 formed in the center of the piston 2 and a dispensing valve (hereinafter, referred to merely as "valve") 6 which is connected to an upper end of the tube 4 and closes an upper opening 5 of the vessel 1. The vessel 1 is a known deep-drawn can having a trunk 7, shoulder 8 and a dome-like bottom 9 formed as one body. The vessel 1 can be produced of an aluminium sheet for example. In addition to the deep drawn can, a vessel assembled by a trunk made of a cylindrically curled steel sheet, a bottom part and a shoulder part can be employed. Further another vessel made of synthetic resin or glass can also be used.

The inside of the vessel 1 is separated by the piston 2 into the lower first chamber (stock solution chamber) N1 and the upper second chamber (pressurized gas chamber) N2. As the piston 2 moving up and down, volumes of the chambers N1, N2 vary.

The piston 2 has a bottom plate 10 having a dome shape according to the shape of bottom 9 of the vessel 1, a side wall 11 rising from the periphery thereof, a boss 12 provided on the center of the bottom plate 10, and rib plates 13 connecting the side wall to the upper end of the boss, so as to form a cup-like shape with upper opening. The center of boss 12 is formed with the above-mentioned hole 3. The side wall 11 slides along an inner surface of the vessel 1 and is elastically bendable. The free end or upper end of the side wall 11 can be elastically deformed inwardly in some extent, so that the side wall 11 can function as a check valve to allow motion of gas from the first chamber N1 under the piston 2 to the second chamber N2, but not easily allow the motion of gas in the opposite direction. Beside, the boss 12 can be formed so that a gap between the boss 12 and the tube 14 functions as a check valve. The above-mentioned side wall 11 abuts against the lower face of the shoulder 8 of the vessel 1 when the piston 2 lifts up so that the piston cannot move upward further. That is, the side wall 11 functions as a stopper.

The above-mentioned piston 2 can be made of synthetic resin such as polyethylene, polypropylene, polyacetal, polyamide(nylon), polyvinyl chloride, ethylen-vinyl acetate copolymer(EVER), poleythylene terephthalate, and the like, especially engineering plastic, synthetic resin elastmer, rubber such as NBR (butadien-acrylonitrile rubber), or composition thereof or combination thereof. Further, the piston can be made by combining some parts or members. Each part might be made of sole material or some materials.

The above-mentioned valve 6 has been known. The valve 6 has a mounting cup 15, a housing 16 held by the mounting cup 15, a stem 17 housed in the housing 16 movably in up-down direction, a spring 18 for urging the stem upward, a gasket 19 interposed between the housing and the mounting cup, another gasket 21 to be attached in periphery of the mounting cup 15 for sealing between the mounting cup and a bead 20 of the vessel 1, and the like.

The above-mentioned tube 4 can be made of a synthetic resin similar to the piston 2 and is preferably bendable elastically in some extent. However, a hard tube without bendability also can be used. The tube 4 is attached to the lower end of the housing 16 and functions as a passage to connect the inside of the housing to the first chamber N1 under the piston 2.

The above-mentioned dispensing container A can be produced as explained hereinafter, for example. At first, referring to step S1 in FIG. 1, a piston 2 is inserted into the inside of a vessel 1 of which shoulder 8 is not formed as shown by imaginary line 8*a*. Then, the upper portion of the vessel 1 is drawn as shown by arrow mark H to form a shoulder 8. Further, the cylindrical upper end portion is curled to form a bead 20. Then, as inserting a tube 4 into a hole 3 of the piston 3 as shown by arrow mark J, the dispesing valve 6 is mounted on the bead 20. Further, the mounting cup 15 of the valve 6 is crimped against the bead 20 to joint to the vessel as one body. By those steps, a dispensing container A before loading of stock solution and propellant is produced.

Hereinafter, referring to FIG. 1, a process for producing a dispensing device by loading pressurized gas and stock solution into the empty dispensing container A will be explained. In FIG. 1, Si shows the above-mentioned step for assembling a dispencing container A, and S2 and S3 are a step for loading pressurized gas and a step for loading stock solution, respectively. The pressurized-gas-loading step S2 is a step for injecting pressurized gas into the first chamber N1 from the valve 6 through the tube 4 to fill the first chamber with the pressurized gas. As loading of the pressurized gas proceeds, the piston 2 lifts with compressing the second chamber N2, and further, the piston makes the pressurized gas to move into the second chamber gradually by means of the check valve function. In this situation, the side wall 11 functions as a stopper. The air in the vessel 1 might be remained in this step. However, the remaining air might be discharged. Such discharge of air can be performed by means of vacuum discharging in accordance with well known method when the valve is crimped on the vessel, or by opening the valve and sucking with vacuum from the stem after crimping of the valve. In such case that the pressurized gas to be loaded is air, it is not necessary to discharge the remaining air in the vessel 1. In general case, the piston is stopped when the side wall 11 abuts against the lower face of the shoulder 8 of the vessel 1, and a part of the pressurized gas moves to the second chamber N2 side through a gap between the piston 2 and the vessel 1.

Next, at the stock-solution-loading step S3, stock solution is loaded from the valve 6 through the tube 4. The stock solution is forcibly loaded under pressure against the pressure of the pressurized gas. Then, the stock solution pushes out the pressurized gas from the first chamber, and then the stock solution fills the first chamber with replacing the pressurized gas.

The stock solution is preferably sufficiently loaded so as to leak slightly to the second chamber N2, such that the pressurized gas cannot remain in the first chamber N1. Thus, a dispencing device B is completed.

As the above-mentioned pressurized gas, gas which substantially insoluble to the stock solution is employed. For example, compessed gas of nitrogen ($N_2$), carbon dioxide ($CO_2$), air, oxygen ($O_2$), argon ($Ar_2$), and the like can be employed. Liquefied gas is not used usually. As the stock solution, liquid such as aqueous solution, alcoholic solution, and the like, semi-solid material such as creamy food, toothpaste, and the like can be employed. The ratio of pressurized gas and the stock solution is in an extent about 30:70–50:50, preferably 35:65–45:55 in volume ratio. In the above-mentioned embodiments, the height of the side wall 11 of piston 2, which functions as a stopper, is preferably determined according to the loading ratio.

As described above, in the producing process of the present invention, inversely to a conventional process, pressurized gas is loaded at first, and stock solution is loaded thereafter. And the pressurized gas and the stock solution are loaded from the same valve 6. Therefore, the loading work is easy, and separated gas-loading-valve is not necessary. The dispensing device B produced as mentioned above can be used similarly to a conventional device. That is to say, when the first chamber N1 is opened by pushing a push button (reference mark 22 in FIG. 2), the pressurized gas in the second chamber N2 press the stock solution in the first chamber N1 through the piston 2. Then, the stock solution can be released through the tube 4 and a nozzle or spout of the push button 22.

Figure 3:
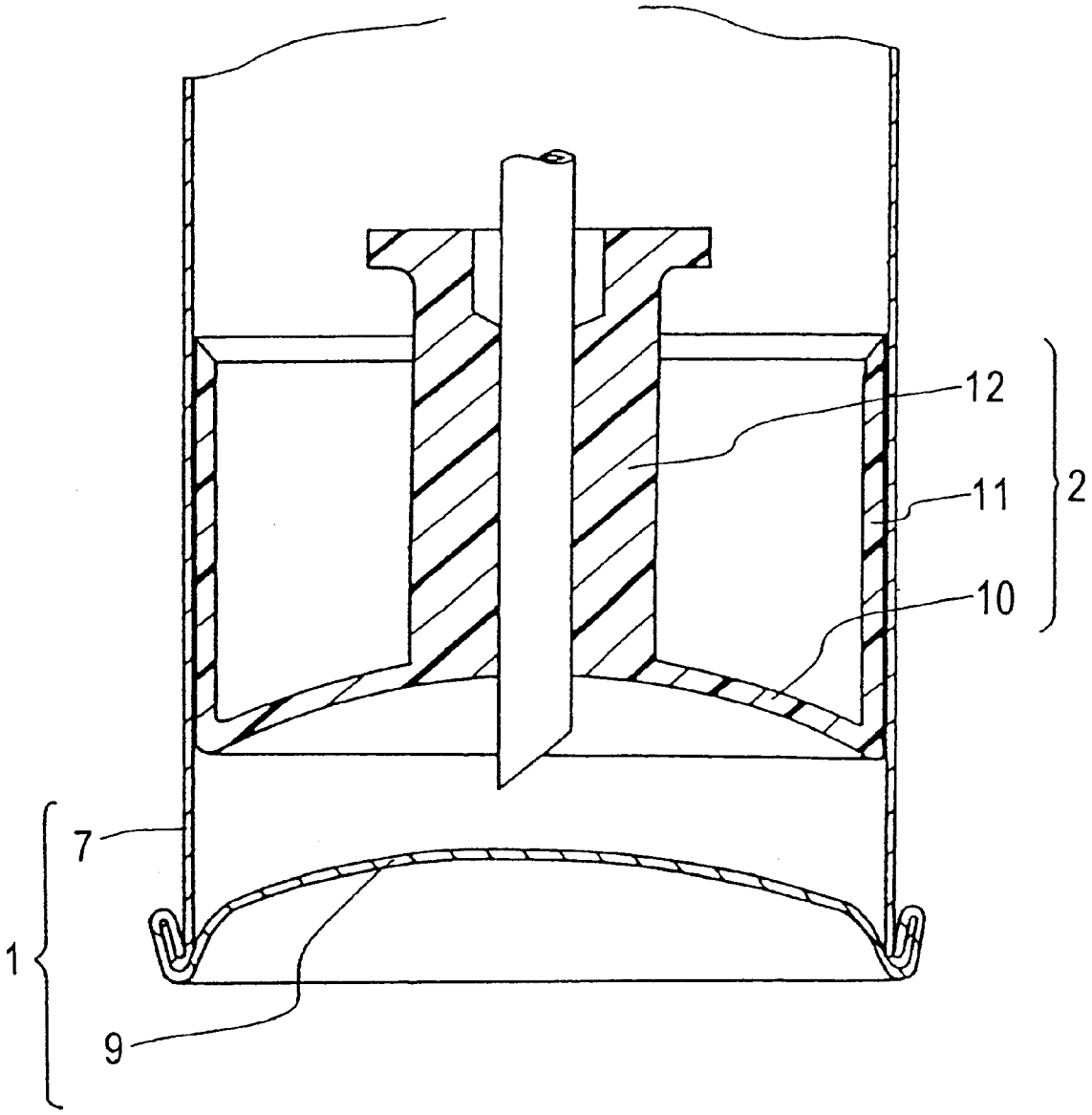
FIG. 3 and FIG. 4 are sectional views showing another embodiments of the dispensing device of the present invention, respectively.

In the above-mentioned embodiment, the side wall 11 of the piston 2 is abutted against the lower face of the shoulder 8 of the vessel 1 so as to function as a stopper. However, as shown in FIG. 3, the boss 12 might be extended over the side wall 11 so that the boss 12 can be used as a stopper for abutting against the lower end of the valve. Beside, as shown in FIG. 3, the vessel 1 might be made by assembling a curled trunk 7, a bottom 9 and a shoulder produced separately. In such case, the piston 2 can be inserted from a bottom side opening, and the bottom 9 can be fixed by curling to the trunk thereafter.

Figure 4:
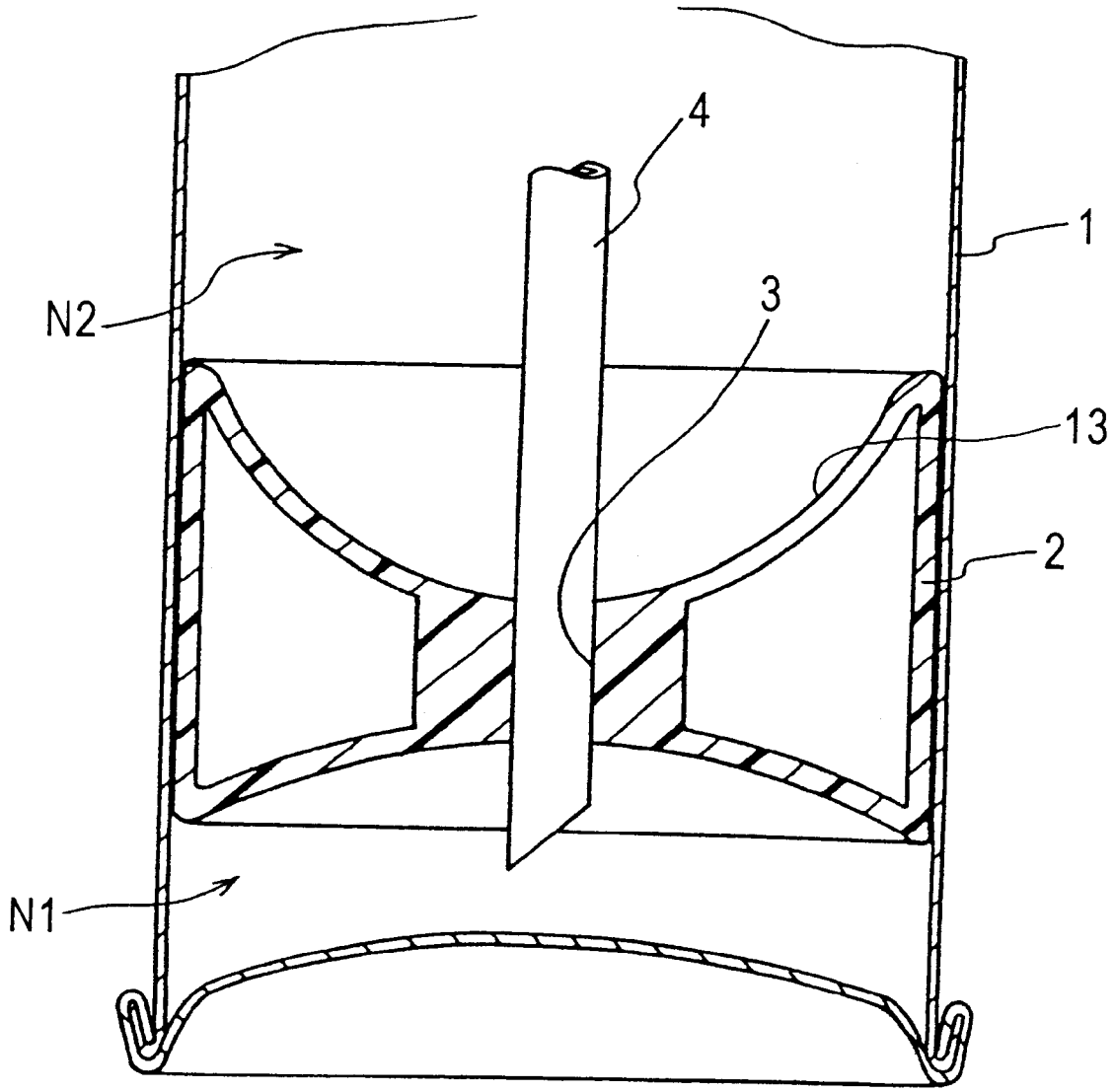

Beside, in the above-mentioned embodiment, the piston 2 has a cup-like shape which opens upward. However, shape of the piston is not limited in the dispensing container of the present invention. As shown in FIG. 4, the piston 2 can be formed to a hollow float. In this case, permeation of the contents through the piston can be sufficiently prevented. In the piston 2 of FIG. 4, the upper plate 13 has a bowl-like shape so as not to interact with the valve when the piston 2 lifts up.

Figure 5:
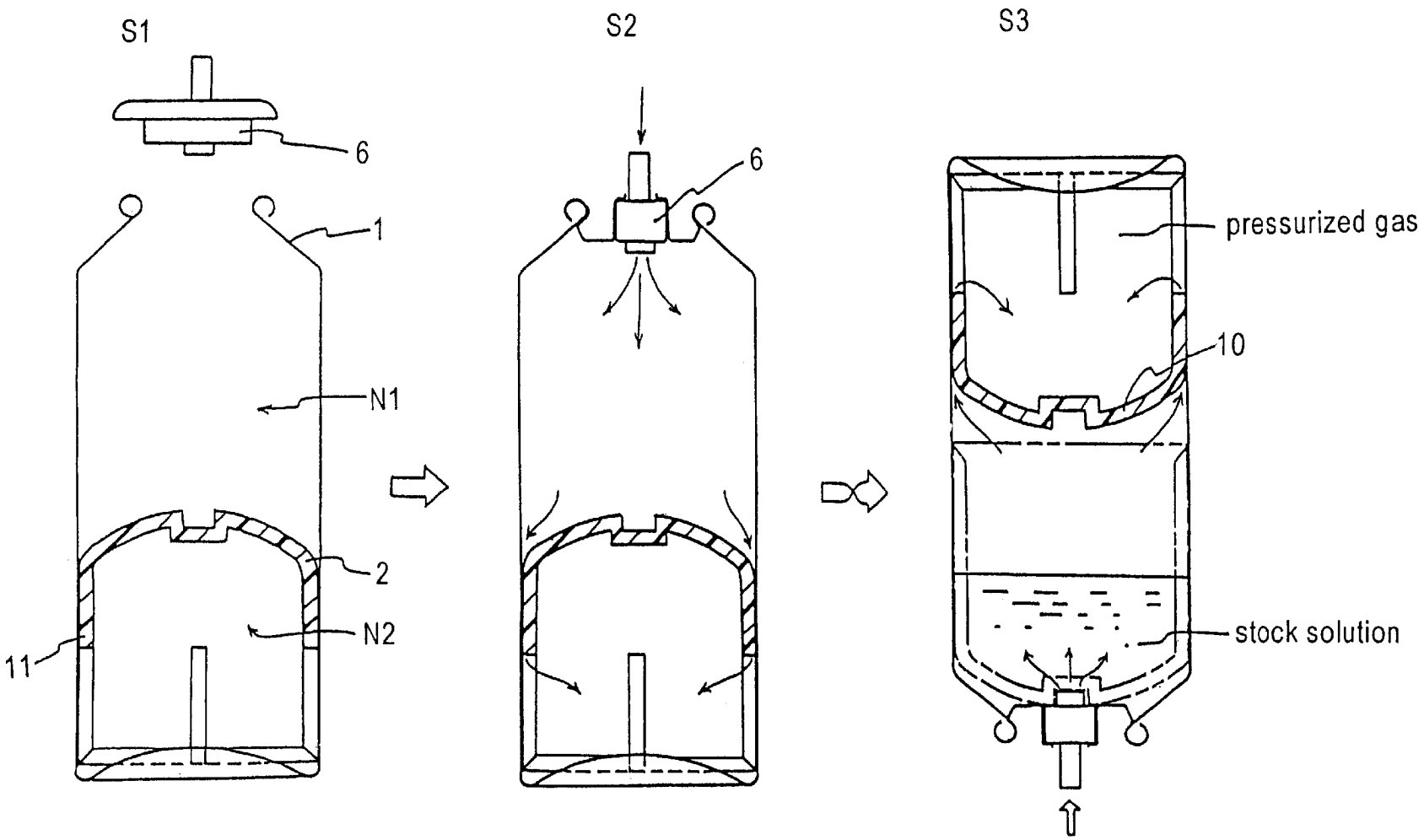
FIGS. 5 to 7 are process drawings showing another embodiment of the producing process of the present invention.

In the above-mentioned embodiment, the pressurized gas is loaded at the upper side, and the stock solution is loaded at the lower side chamber N1. However, as shown in FIG. 5, the upper side can be a first chamber N1 to be filled with stock solution, and the lower side can be a second chamber N2 to be filled with pressurized gas. FIG. 5 shows an embodiment of a process for producing such dispensing device. This producing process, similarly to the case of FIG. 1, comprises a container-assembling step S1, a pressurized-gas-loaded step S2 and a stock-solution-loading step S3.

The dispensing container does not need any tube (4 in FIG. 1). The piston 2 is inserted with an inverted posture upside down. Therefore, the piston 2 has check valve function to allow flow of fluid from the upper first chamber N1 to the lower second chamber N2, but restrict the flow in the inverse direction. In this case, the side wall 11 of the piston can also function as a stopper for securing volume of the second chamber N2.

The container-assembling step S1 and the pressurized-gas-loaded step S2 are the same as the case of FIG. 1. However, in the stock solution loading step S3, the stock solution is loaded with setting the container upside down, since the pressurized gas should be moved before the stock solution reach to the second chamber N2. This is different point from the case of FIG. 1. The stock solution loading step S3 in FIG. 5 shows a state of half way of the loading. At last, the first chamber N1 is sufficiently filled with stock solution so that the stock solution rather overflow to the second chamber N2. Beside, the lower plate 11 of the piston is preferably curved to project upward (downward in step S3) so that the pressurized gas remaining in the first chamber N1 is reduced as far as possible.

Figure 6:
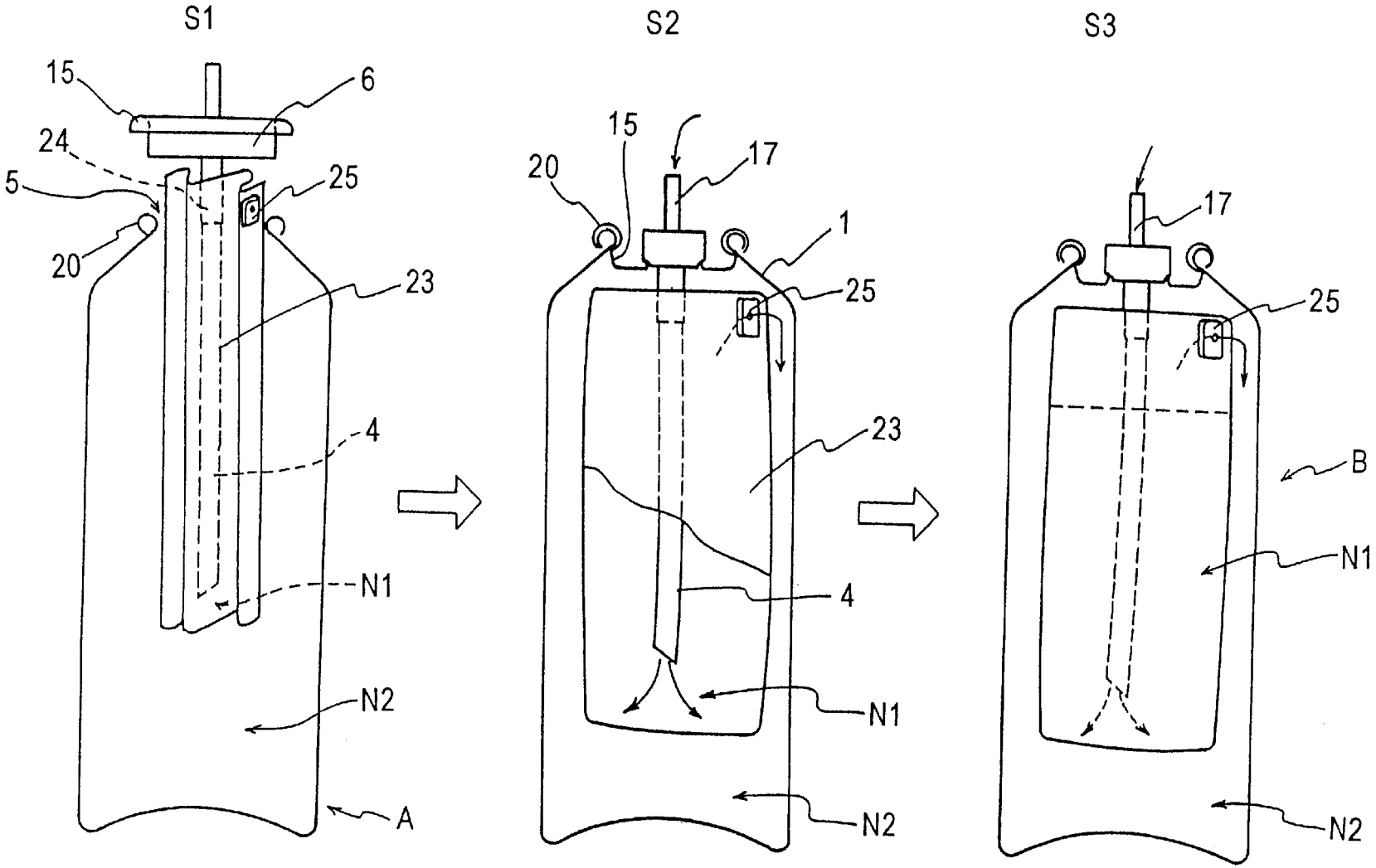
Figure 7:
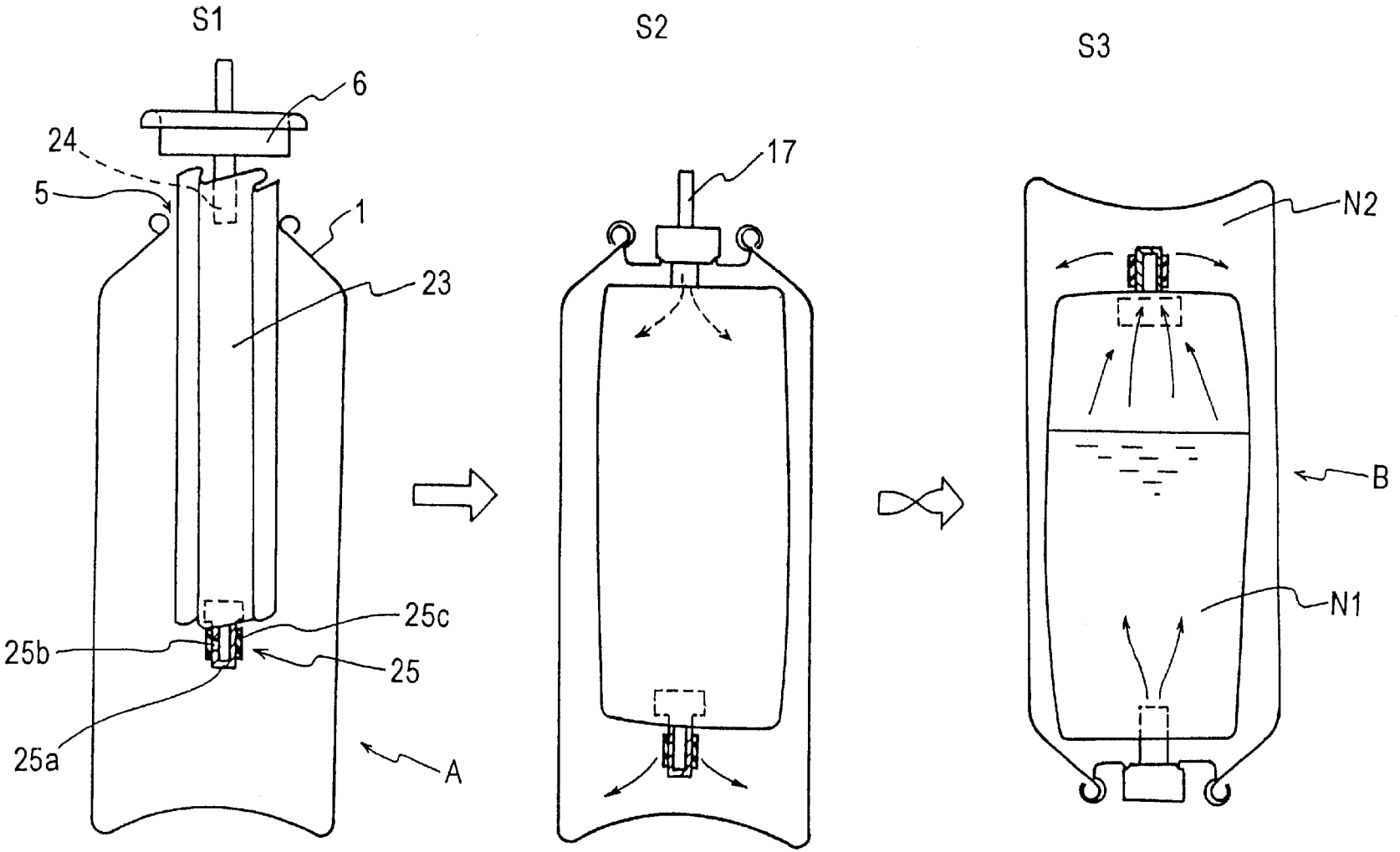

In the above-mentioned embodiments, a piston 2 is employed as a barrier wall. However, as shown in FIG. 6 and FIG. 7, a known deformable inner bag 23 can also be employed as a barrier wall. In the embodiment of FIG. 6, the inner bag 23 is made of two sheets or films of which peripheries are welded, heat sealed or adhered with each other to form a bag. The inner bag 23 is fixed to a valve 6 having a tubular portion 24 extending downward. The tubular portion 24 is sandwiched between sheets of the inner bag 23. However, another shape of inner bag can be employed. For example, an inner bag having a periphery or flange around an opening to be crimped on an bead 20 around an opening 5 of the vessel together with a mounting cup 15, can be employed. A mono-film synthetic resin, a laminated film of synthetic resin films, a laminated film of a synthetic resin film and a metal foil, and the like can be used for the sheet of the inner bag 23. If demanded, a container made of thin metal sheet, for example 0.2–0.4 mm in thickness, which is collapsible under pressure, can be employed.

In this embodiment of dispensing container, the inner bag 23 is provided with a check valve 25 at the upper end thereof. The check valve 25 allows the flow of fluid from the inside of the inner bag 23 (first chamber N1) to the out side (second chamber N2) which is a space between the inner bag 23 and the vessel 1, but does not allow the inverse flow substantially from the out side to the inside. In this case, the flow from the out side to the inside might be in an extent merely to be resisted by the check valve. It is preferable to attach a tube 4 to the tubular portion 24 of the valve 6 so that the stock solution can fill the inner bag 23 gradually from the bottom side thereof.

As shown at the container-assembling step Si, the inner bag 23 is folded along longitudinal lines when the bag is inserted into the vessel 1 and is expanded at the inside of the vessel 1. By crimping the mounting cup 15 on the bead 20 of the vessel 1 under this situation, a container is completely assembled.

At the pressurized-gas-loading step S2, pressurized gas is loaded from the stem 17 into the first chamber N1 in the inner bag to expand the inner bag, and further the pressurized gas is also loaded in the second chamber N2 between the inner bag 23 and the vessel 1 through the check valve 25. In this case, the pressure in the vessel 1 becomes 5–12 $kgf/cm^2$ for example. However, since the inside and the out side of the inner bag 23 are balanced in pressure, the inner bag 23 is not broken.

Next, at the stock-solution-loading step S3, stock solution is charged from the same stem 17 under pressure. Therefore, the pressurized gas in the inner bag 23 moves to the second chamber N2 through the check valve 25, and the inner bag 23 is filled with the stock solution without pressurized gas. In this case, it is preferable that the stock solution overflow slightly to the second chamber N2.

A dispensing container shown in FIG. 7 has a check valve 25 at the lower end of the inner bag 23 and is not provided with any tube. The remaining construction is substantially the same as that of FIG. 6. In this embodiment, when the stock-solution-loading step S3, the container is kept upside down so that only pressurized gas moves to the second chamber N2 through the check valve 25.

The check valve 25 can be obtained, for example, by forming a through hole 25*b* in the side wall of the tubular portion 25*a* having a closed end, and by fitting an elastically deformable tube 25*c* around the tubular portion 25*a*. Further, a known check valve having a ball urged by a spring can also be employed.

The dispensing device assembled as mentioned above is completed at last by mounting a push button or spout on the stem 17. By pushing the push button of the obtained dispensing device B to open the valve 6, the stock solution in the inner bag 23 pressurized by the pressurized gas in the second chamber N2 can be released through the nozzle or the like of the push button.

In any embodiment mentioned above, since the pressurized gas in the second chamber N2 is sealed by the stock solution in the first chamber N1 by means of "liquid seal", sealing effect is high. Therefore, the device is especially advantageous for a dispensing device in which compressed gas sensitive to leakage is used as a propellant. However, when the pressurized gas is discharged in order to reduce the inner pressure of a used container for safe abandonment, the good seal function is inconvenient on the contrary. Then, it is preferable to provide a forcibly-connecting-means capable of automatically cancelling the seal function of the barrier wall when the container is used entirely.

Figure 8A:
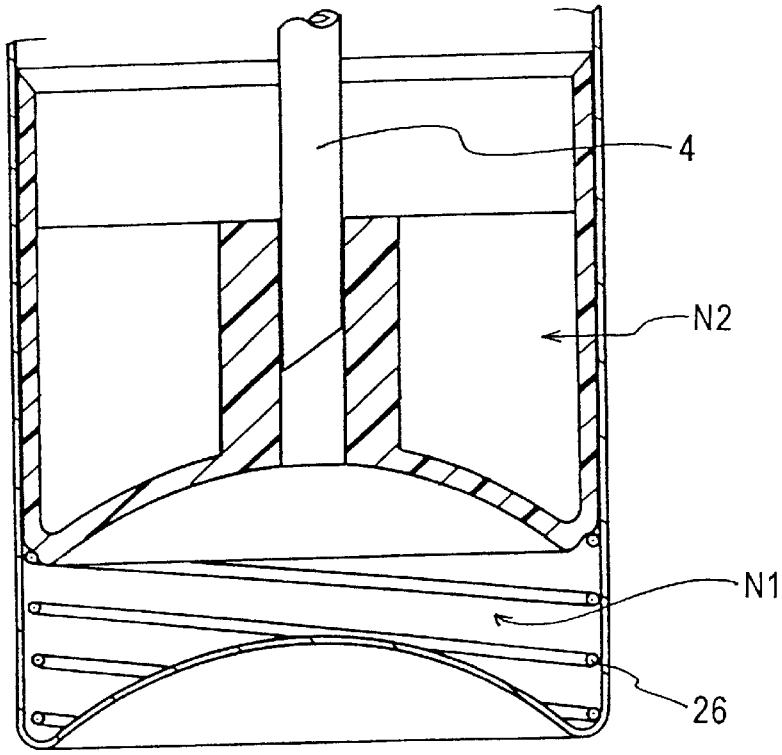
FIG. 8*a* is a sectional view in part showing another embodiment of the dispensing container of the present invention.

FIG. 8*a* shows a type of dispensing container in which a first chamber for stock solution under a piston is connected with a valve through a tube. The tube 4 is slightly short such that the lower end of the tube 4 comes out of a boss 12 of the piston 2 when the piston as a barrier wall reaches the bottom. Therefore, when the stock solution is used almost entirely, the second Ad chamber N2 is connected with inside of the tube 4. Then the pressurized gas can be discharged through the valve 6. Therefore, the device can be thrown away safely with reduced inner pressure. Further, the device is preferably provided with a temporary stopping leg 26 such as a coil spring or the like between a bottom 9 of the vessel 1 and a lower plate 10 of the piston 2 such that the piston 2 does not slip off the tube 4 before loading of pressurized gas. The temporary stopping leg 26 has such strength (repulsing force of spring in this embodiment) that the piston 2 can be prevented from slipping off the tube 4, and the piston 2 can slip off the tube 4 by means of pressure of the pressurized gas when the stock solution is used almost entirely by using up the dispensing device.

In addition to a spring with predetermined repulsive force, such temporary-stopping leg 26 can be made of a leg or legs extending downward from periphery of the piston, capable of being broken with predetermined compressive force, or the like.

Figure 8B:
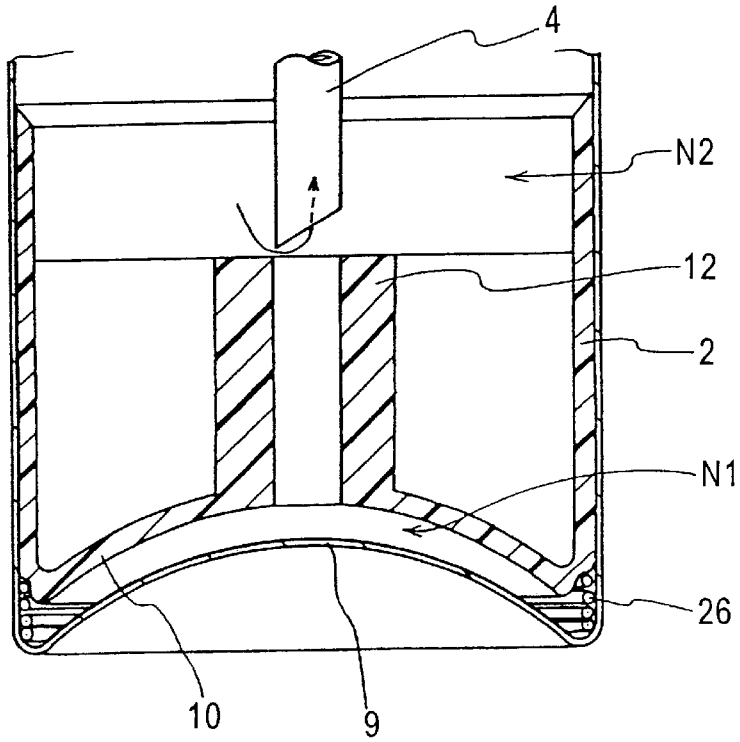
FIG. 8*b* is a sectional view in part showing an operating state thereof.
Figure 9:
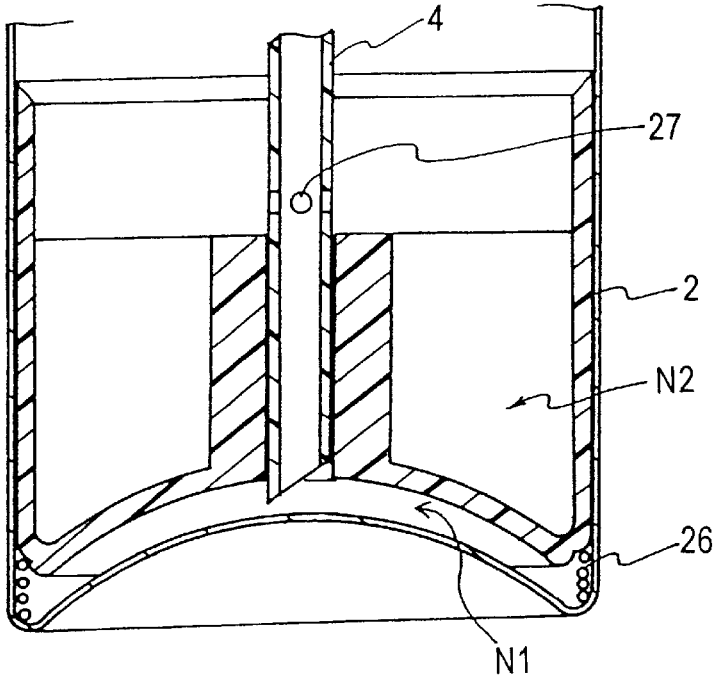
FIG. 9 and FIG. 10 are sectional views in part showing further another embodiments of the dispensing container of the present invention, respectively.

FIG. 9 shows a dispensing container similar to the dispensing containers of FIG. 8*a* and 8*b*. In this embodiment, a tube 4 having a through hole 27 formed at a half way instead of the above-mentioned short tube. In this dispensing container, when the stock solution is used up and the piston comes to the bottom, the second chamber N2 is connected with the inside of the tube 4. The dispensing container is also preferably provided with a temporary-stopping leg 26.

Figure 10:
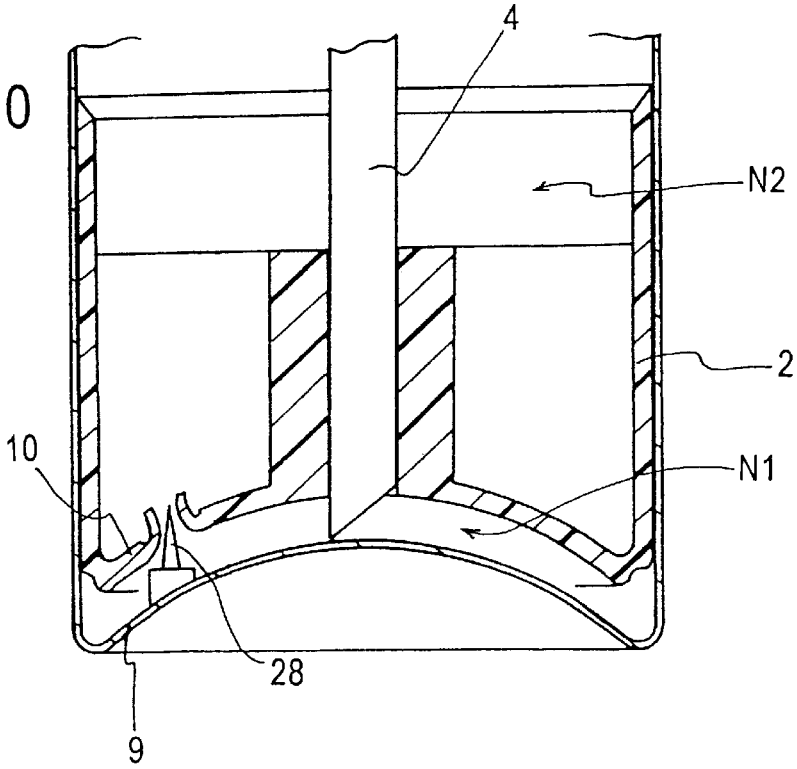

FIG. 10 shows another embodiment of forcibly connecting means having a pin or spike 28 fixed at the bottom 9 of the vessel 1 so as to direct upward. In this embodiment, when the piston 2 as a barrier wall comes to the bottom, the spike 28 can break through the lower plate 10 of the piston 2 to connect the first chamber N1 to the second chamber N2. This embodiment is also preferably provided with a temporary-stopping leg similar to a temporary-stopping leg 26 as seen in FIG. 8*a* and the like.

Further, another type of forcibly connecting means can be obtained by providing a projection or the like at a trunk, a bottom or a shoulder of the vessel 1. The projection can engage with the piston to deform the piston 2 so as to cancel the seal function of the piston 2.

Figure 11A:
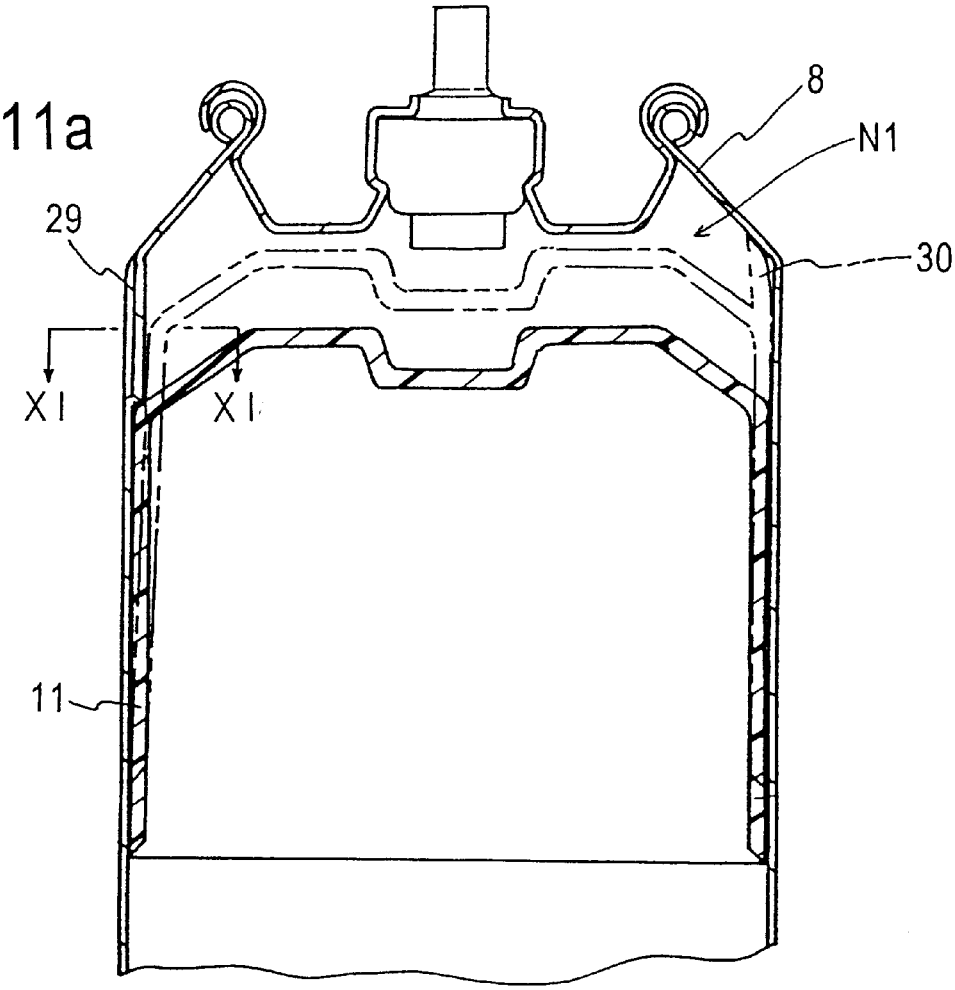
FIG. 11*a* is a sectional view in part showing another embodiment of the dispensing container of the present invention.
Figure 11B:
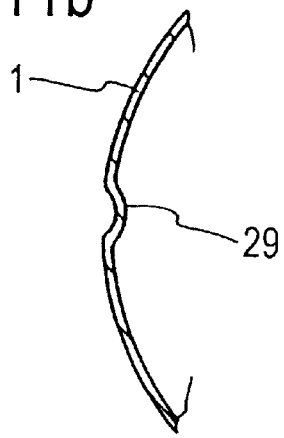
FIG. 11*b* is a sectional view along line XI—XI thereof.

FIG. 11*a* shows one of the embodiments of such type of dispensing container. In this embodiment, a first chamber N1 for stock solution is set at the upper side of piston 2, and the trunk of the vessel 1 is provided with a rib or ribs (see FIG. 11*b*) 29 projecting inward at the upper portion of the trunk. In this embodiment, when the stock solution is used up and the piston comes to the upper end, the side wall 11 of the piston runs on the ribs 29 to be deformed. Therefore, seal function is released and the first chamber N1 is connected with the second chamber N2. As shown by imaginary lines in FIG. lla, the piston 2 might be provided with an extending portion 30 at the upper end thereof, which abuts with the shoulder 8 of the vessel 1 and deforms the piston so as to connect the first chamber N1 to the second chamber N2 when the piston 2 lifts to the upper end.

Figure 12:
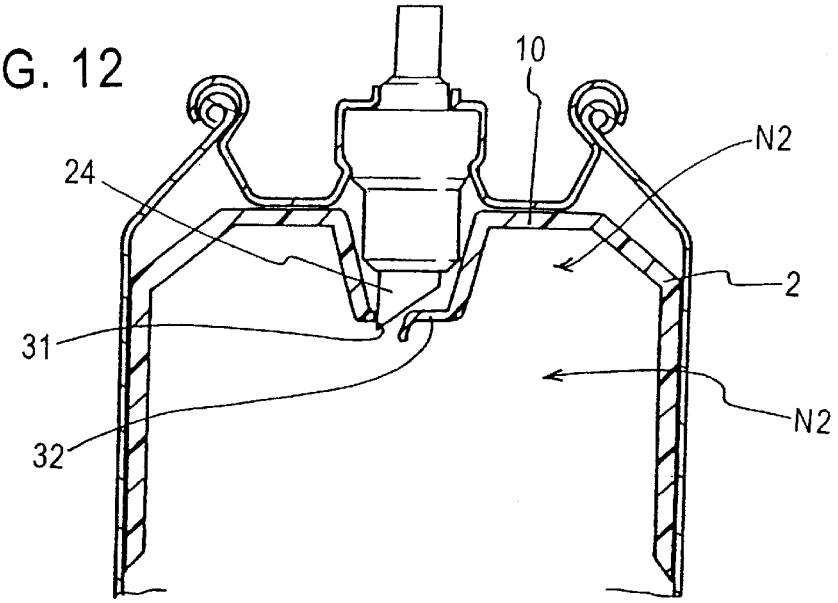
FIGS. 12, 13, 14 and 15 are sectional views in part showing further another embodiments of the present invention.

FIG. 12 shows a type of dispensing container in which stock solution is loaded in the upper side of the piston 2. In this container, a valve 6 has a hard tube or tubular portion 24 at the lower side thereof, and a sharp edge 31 is formed at the lower end of the tubular portion 24. In addition, a lower plate 10 of the piston 2 has a thin portion 32 to be broken by the sharp edge 31. Therefore, when the piston goes to the upper end, the second chamber N2 is connected with the inside of the tube 4 through the tube 4 piercing through the piston 2.

Figure 13:
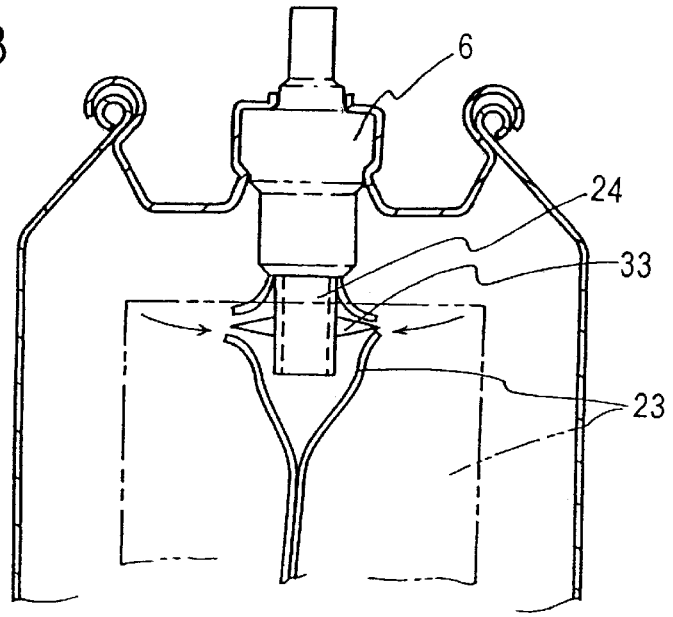

FIG. 13 shows a dispensing device having an inner bag 23 and a tube or tubular portion 24 at the lower side of the valve 6. The tubular portion 24 has spikes 33 projecting in the side directions. In this embodiment, when the stock solution in the inner bag 23 is used up, the inner bag 23 is broken by the spikes 33, and the first chamber N1 is connected with the second chamber N2. In stead of the spikes 33, a tubular projection with sharp edge at the free end thereof might be employed. In this embodiment, when the inner bag 23 is broken, the second chamber N2 is directly connected to the inside of the tube 4. Those forcibly connecting means can be applied not only to a dispensing container having a check valve at the upper side of the inner bag 23, but also to a dispensing container having a check valve at the lower side of the inner bag.

Figure 2:
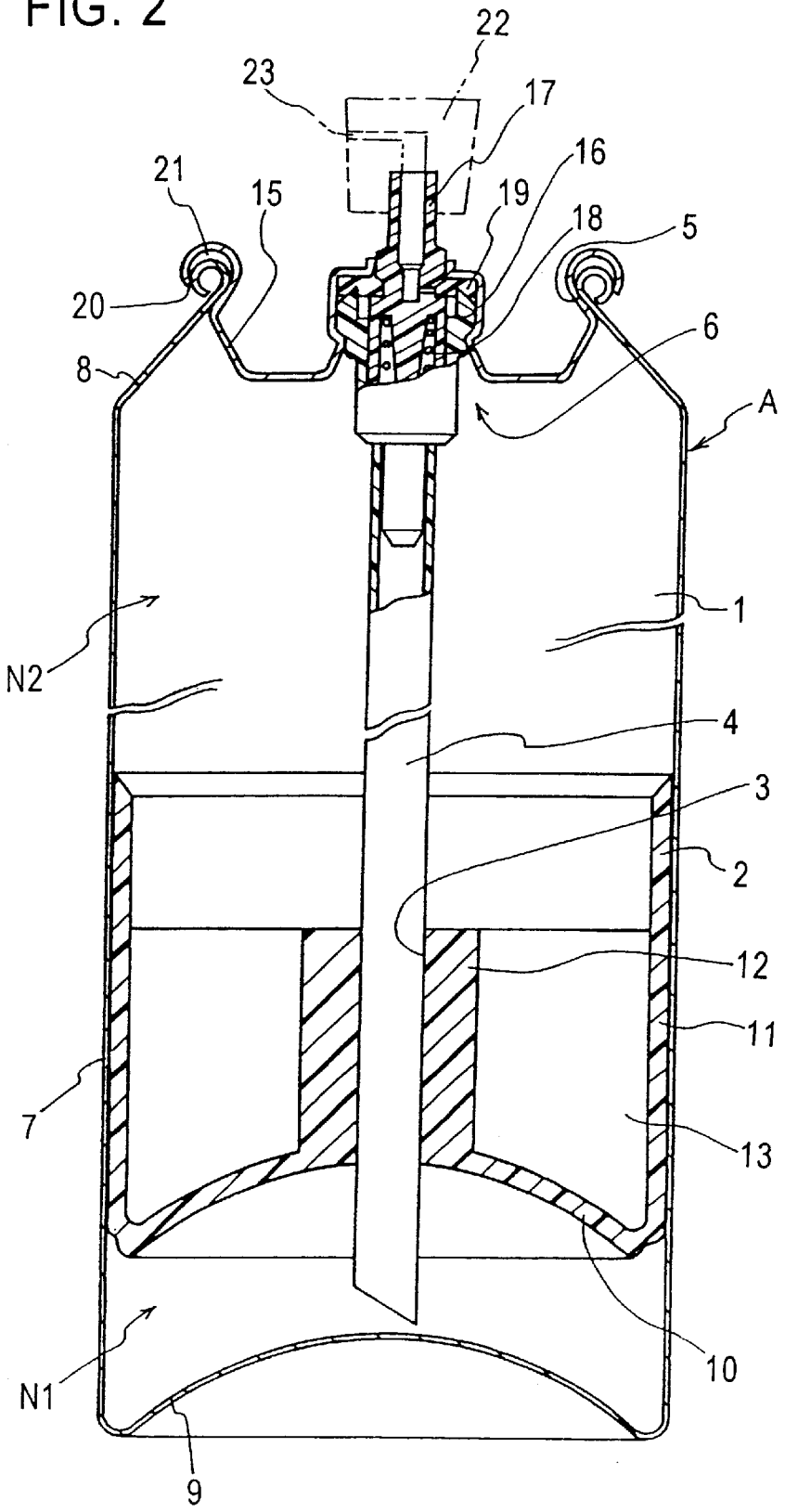
FIG. 2 is a sectional view showing an embodiment of the dispensing container of the present invention to be used for the process.
Figure 14:
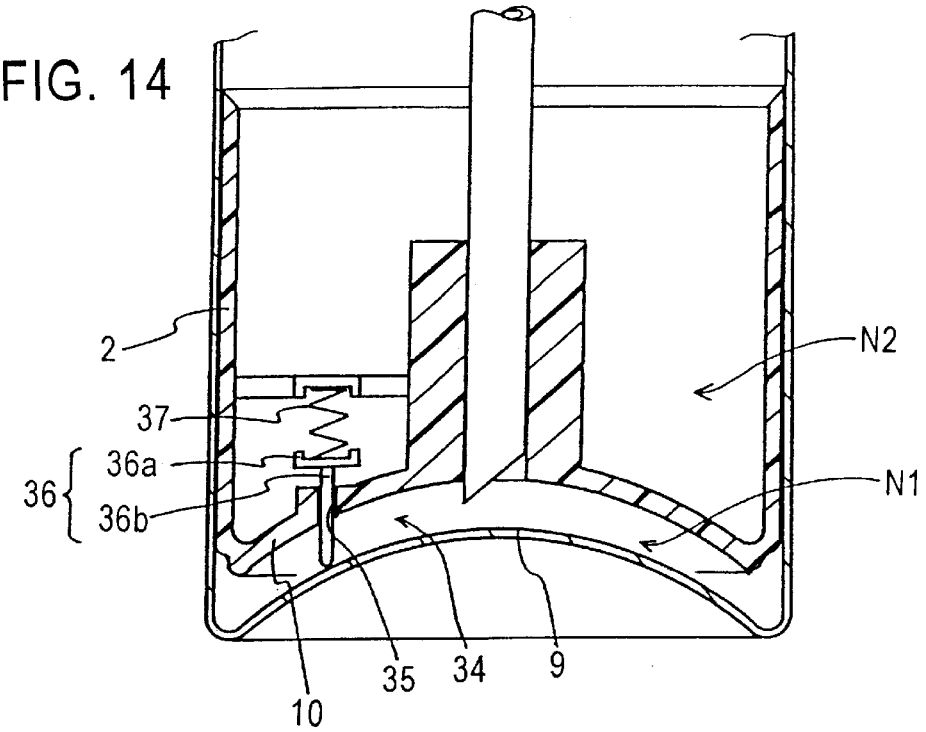

FIG. 14 shows an embodiment of a dispensing container similar to the dispensing container of FIG. 2. This embodiment has a piston 2 provided with a check valve 34, which can function as a forcibly connecting means, at a lower plate 10 thereof. The check valve 34 has a hole 35 through a lower plate 10 of the piston 2, a valve body 36 and a spring 37 for urging the valve body 36 toward the lower plate 10 side. The valve body 36 has a seat 36*a* for closing the hole 35 from the second chamber N2 side and a shaft 36*b* projecting to the first chamber N1 side through the hole 35. The check valve 34 functions as a check valve for allowing the flow of fluid from the first chamber N1 to the second chamber N2 in ordinary case. In addition, when the piston goes to the bottom 9 of the vessel 1, the shaft 36*b* of the valve body 36 abuts against the bottom 9 so as to lift the valve body 36 and to connect the first chamber N1 to the second chamber N2. Therefore, in this situation, the check valve 34 functions as a forcibly connecting means.

Figure 15:
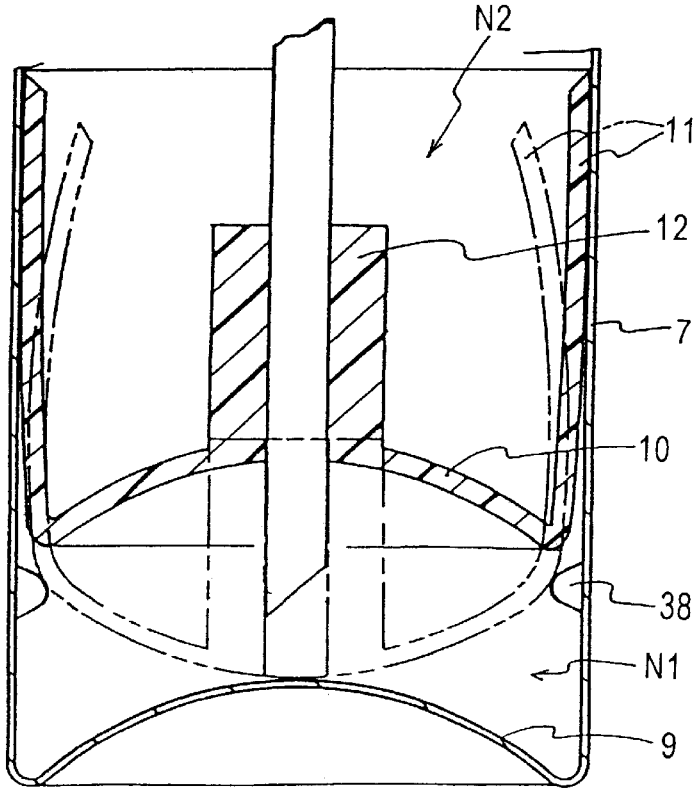

FIG. 15 shows a dispensing device similar to the dispensing device of FIG. 2. In this embodiment, the piston 2 has a lower plate made of a dome-like thin plate projecting upward and deformable in the inverse direction. The piston 2 has a boss 12 projecting downward from the center of the thin plate. In addition, the bottom 9 of the vessel I is provided with an abutting member 38 at periphery thereof capable of abutting with the lower periphery of the piston 2. Therefore, when the piston reaches the bottom, the lower periphery thereof abuts with the abutting member 38 at the bottom 9 of the vessel 1, and the lower plate 10 is deformed to project downward. Therefore, a gap is generated between the side wall 11 and the trunk 7 of the vessel 1, and the first chamber N1 is connected to the second chamber N2. Therefore, this member is also a forcibly connecting means.

Hereinafter, referring to FIGS. 16 through 18, another embodiment of the process for producing a dispensing device of the present invention will be explained. Those embodiments have a step S2A for sucking or discharging pressurized gas from the first chamber N1 after a pressurized-gas-loading step S2 and before a stock-solution-loading step S3, not similar to the above-mentioned producing process.

Figure 16:
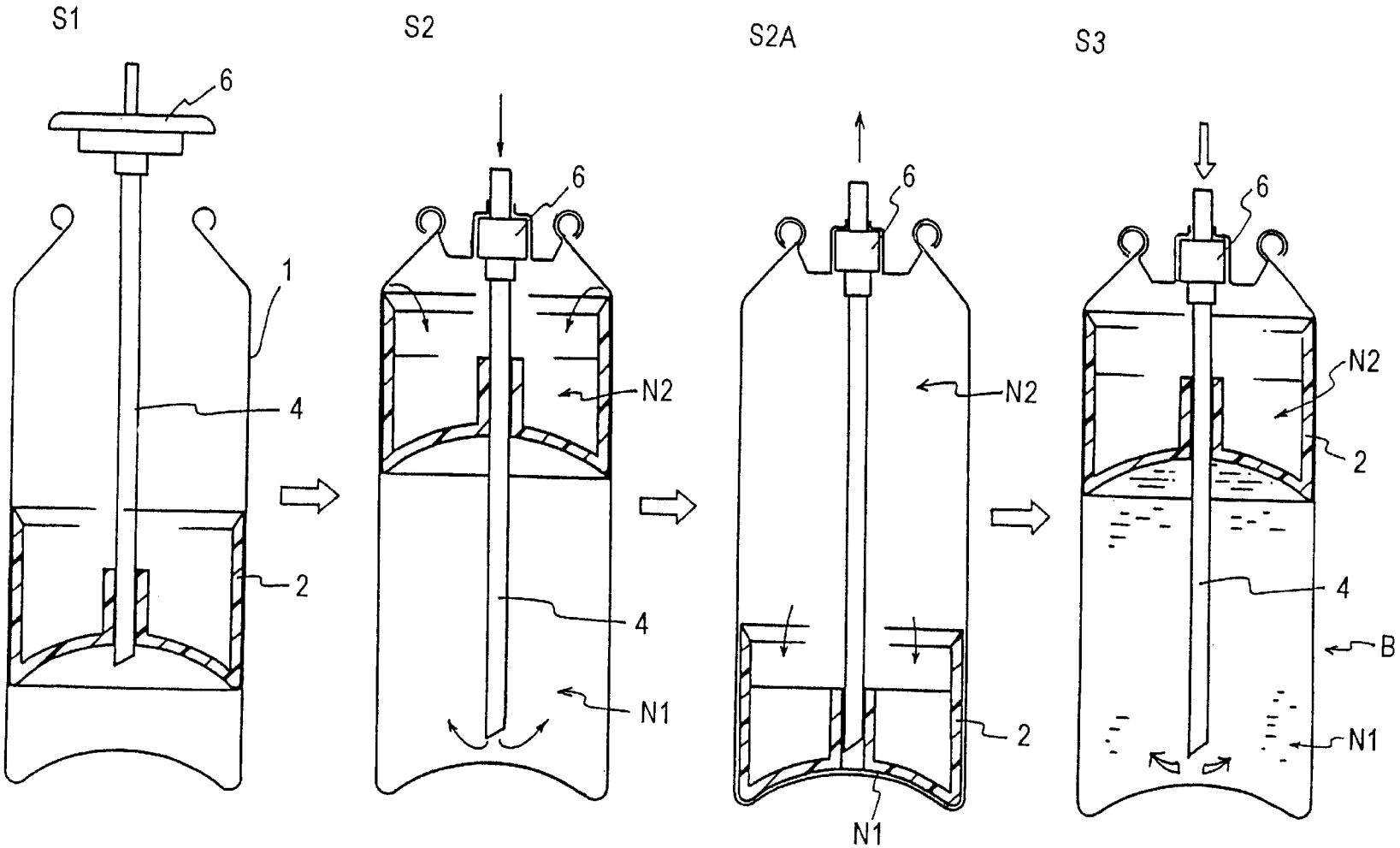
FIGS. 16, 17 and 18 are process drawings showing further another embodiment of the producing process of the present invention.

In the process of FIG. 16, a dispensing container substantially same as FIG. 1 is employed. Therefore, if the same stock solution and the same pressurized gas are used, the same dispensing device can be obtained.

The left end step Si in FIG. 16 is a step for assembling a container in which a piston 2, a tube 4 and a valve 6 are assembled to a vessel 1 substantially same as FIG. 1. Sequentially to the step, pressurized-gas-loading step S2 for loading pressurized gas into the first chamber N1 through a valve 6 and a tube 4, and further into the second chamber N2, is performed. In this embodiment, the pressure of the pressurized gas loaded at the step S2 is higher than the case of FIG. 1

Then, pressurized-gas-discharging step S2A for discharging the pressurized gas from the first chamber N1 is performed. In this step S2A, the pressurized gas can be collected in a bomb for example through a valve by decreasing the loading pressure lower than the pressure in the container. Further, in a case that the pressurized gas is safe gas such as air, the pressurized gas can be discharged into the atmosphere. In addition, a vacuum can suck the gas from the first chamber N1. In any case, only the pressurized gas in the first chamber N1 is discharged, and the pressurized gas in the second chamber N2 is not discharged by virtue of the function of the check valve. Then, the piston 2 goes down by means of pressure of the pressurized gas remaining in the second chamber N2, and the volume of the first chamber N1 becomes about O as shown in the step S2A in the drawing.

Under the situation, a stock-solution-loading step S3 for loading stock solution through the valve is performed. This step is the same as the case of FIG. 1. When the step is completed, a dispensing device B which is substantially same as the case of FIG. 1 is obtained. Though this embodiment requires an additional pressurized-gas-discharging step S2A in contrast with the case of FIG. 1, there is an advantage that the pressurized gas is not easily blended in the stock solution. However, merit of the process of this embodiment is further realized for a piston-type dispensing device having a second chamber at lower side and a first chamber at upper side as explained hereinafter.

Figure 17:
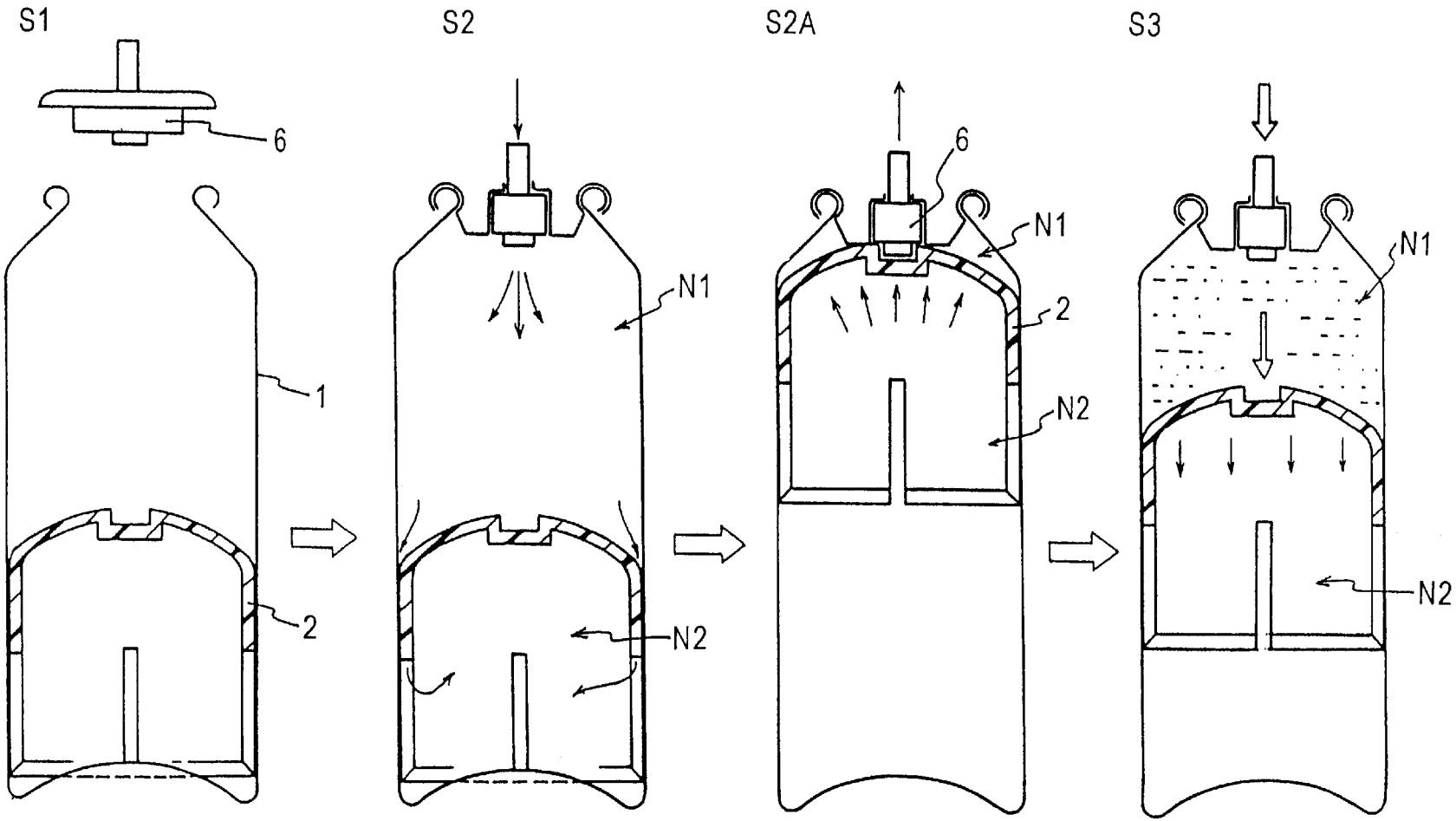

In the producing process of FIG. 17, at first, a container-assembling step S1 is performed with using the same vessel 1, piston 2 and valve 6 as the producing process shown in FIG. 5. Then, a pressurized-gas-loading step S2 is performed. Though those steps are the same as the case of FIG. 5, pressure of the pressurized gas is higher. Then, a pressurized-gas-discharging step S2A is performed. By this step, the pressurized gas in the first chamber N1 is discharged, and the pressurized gas remains only in the second chamber by means of the check-valve-function of the piston 2. By means of the pressure of the remaining pressurized gas, the piston is lifted to the upper end, and the volume of the first chamber N1 becomes about O.

Then a step S3 for loading stock solution into he first chamber N1 is performed. It is not necessary to urn the vessel 1 upside down in contrast to the case of FIG. 5, since pressurized gas do not remain in the first chamber. As mentioned above, in the embodiment, step and apparatus for turning over the vessel during process are not required, and process control is simplified greatly.

Figure 18:
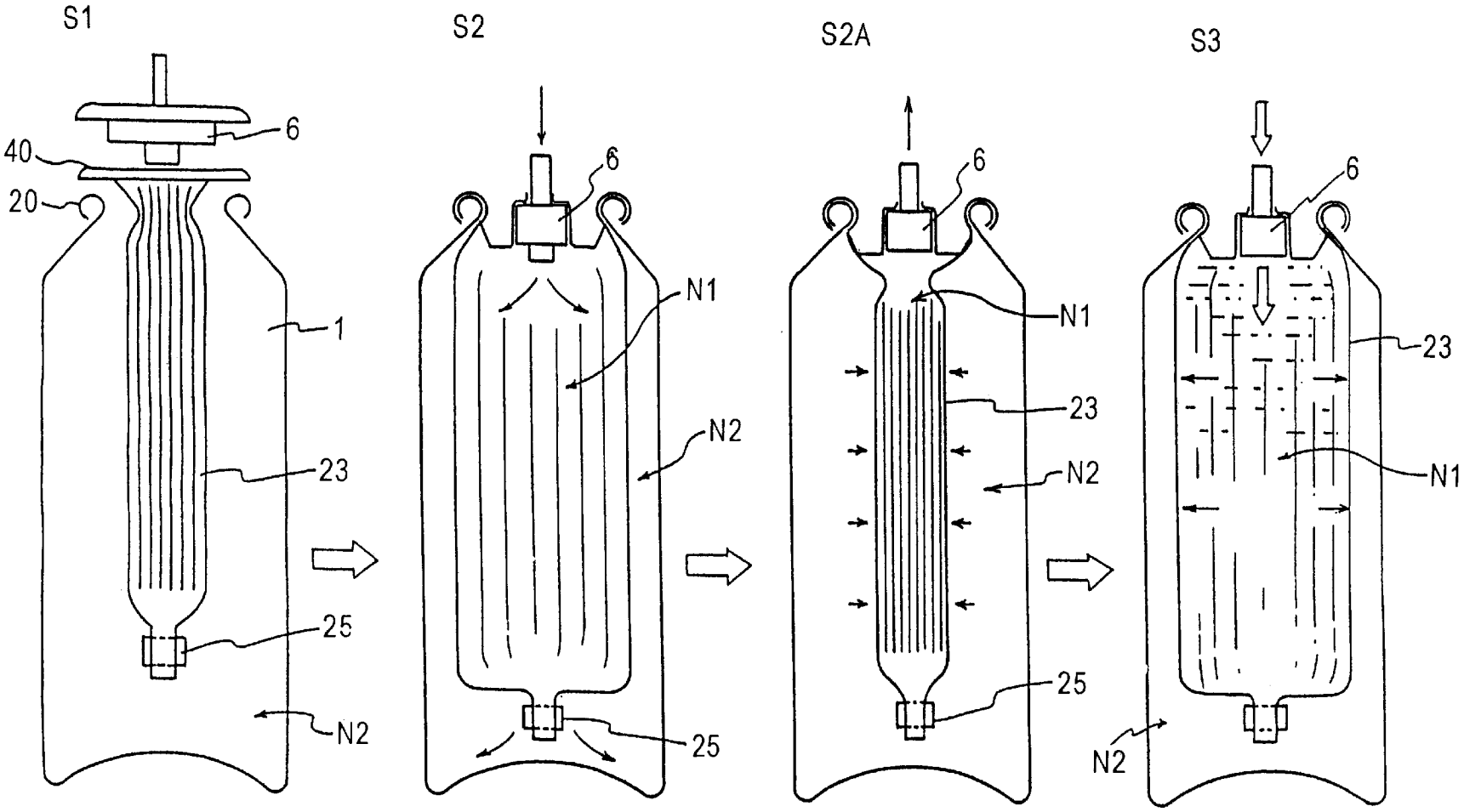

FIG. 18 shows an embodiment of process for producing an inner-bag-type double dispensing device, to which the process having a pressurized-gas-discharging step S2A is applied. That is to say, as same as the process of FIG. 7, a step S1 for assembling as inner bag 23 with a check valve at the lower end and a valve 6 to a vessel 1 is performed. Then, a step S2 for loading pressurized gas into the first chamber N1 in the inner bag 23 through the valve 6, and for loading the pressurized gas into the second chamber N2 through the check valve 25 at the same time, is performed.

Next, a step S2A for discharging the pressurized gas from the first chamber N1 through the valve 6 is performed. In this situation, the pressurized gas in the second chamber N2 is not discharged by means of the function of the check valve 25, and the pressurized gas still remain only in the second chamber N2. Therefore, the inner bag 23 is folded as same as the initially inserted state (step. S), and volume of the inner bag becomes about O.

Next, in the step S3, stock solution is loaded into the inner bag 23 through the valve 6. In this situation, since no pressurized gas remain in the inner bag 23, it is not necessary to return the vessel 1 upside down.

The producing process with pressurized-gas-discharging step can also be applied to the dispensing device having a check valve 25 at the upper side of the inner bag. Though the check valve 25 is provided at the upper side of the inner bag 23, the process is the same as the process of FIG. 18 substantially. Therefore, the process is not shown with drawings.

Figure 19:
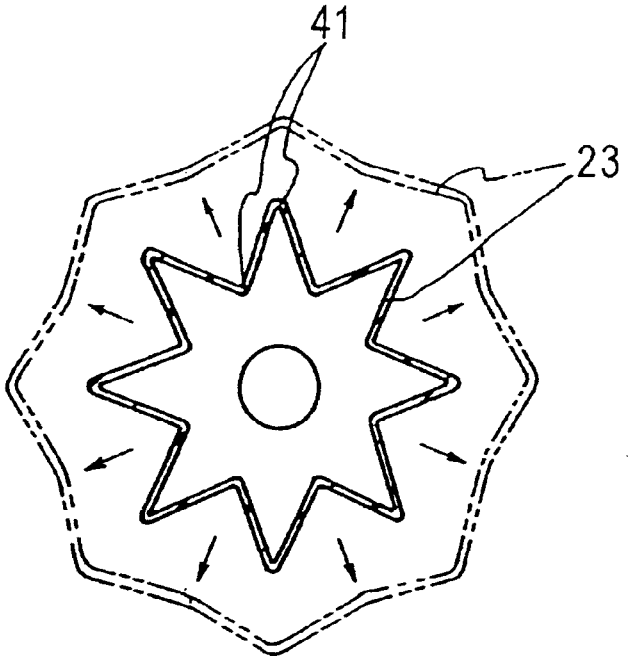
FIG. 19 is a sectional view showing another embodiment of an inner bag relating to the present invention.

The inner bag 23 used in the producing process of FIG. 18 has a flange 40 to be engaged with a bead 20 or curled portion at upper end thereof, which is not similar to the case of FIGS. 6 and 7. In addition, as seen in FIG. 19 the inner bag 31 can shrink along longitudinal folding lines 41 which project outward and inward alternately as shown by real line, and the inner bag can be expanded with inner pressure as shown by imaginary lines 23. Such inner bag 23 can be produced by blow-moulding, for example. The check valve 25 is the same as the case of FIGS. 6 and 7 substantially, and can be constructed by a tubular projection 42 projecting from the bottom of the inner bag 23 and a tube 43 elastically fit around the projection 42.

Figure 20:
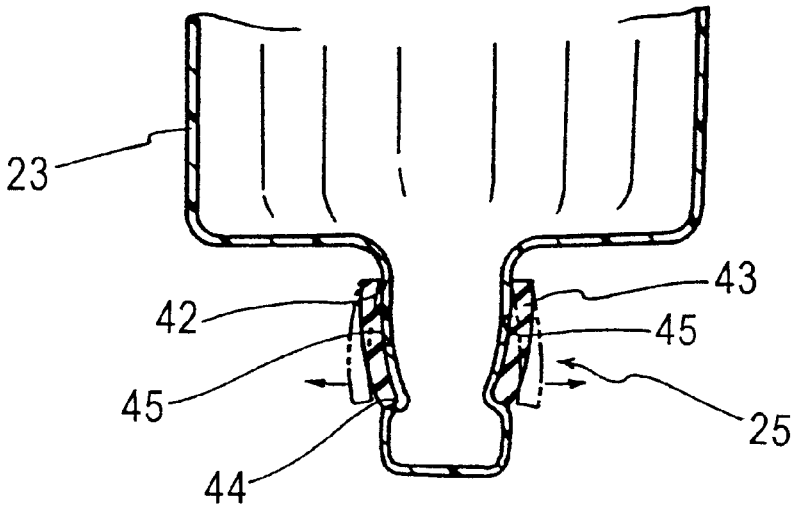
FIG. 20 is a sectional view showing another embodiment of a check valve relating to the present invention.

As seen, for example, in FIG. 20, the tube 43 is made of rubber or the like and is elastically deformable. The tube 43 is preferably engaged with a step portion 44 formed at the lower portion of the projection 42. The tubular projection 42 has a side wall formed with a through hole 45.

In the process for producing a dispensing device of the present invention, steps for loading pressurized gas and stock solution are easy, and it is not necessary to provide any excess gas-loading valve.

By using the dispensing container of the present invention, the above-mentioned process can be easily performed. The dispensing container has a good sealing function of the second chamber filled with pressurized gas.

In addition, in the dispensing device with a forcibly connecting means, inner pressure can be easily lowered after the container is used up entirely.

What is claimed is:

1. A process for producing a double dispensing device;

by providing a pressure-transmittable barrier wall to separate an inside of a vessel into a first chamber and a second chamber, a dispensing valve, a passage to connect the dispensing valve with the first chamber, and a check valve means capable of flowing fluid from the first chamber to the second chamber in a pressure vessel;

loading pressurized gas substantially insoluble to stock solution into the first chamber from the valve through the passage, and further bringing the pressurized gas to the second chamber through the check valve means; and loading stock solution into the first chamber through the passage from the valve.

2. The producing process of claim 1, wherein:

at the step of loading stock solution from the valve, the gas remaining in the first chamber is forcibly brought to the second chamber by means of a stock solution loaded into the first chamber.

3. The producing process of claim 1, wherein:

the gas remaining in the first chamber is discharged through the valve after the step of loading the gas; and thereafter, the first chamber is loaded with the stock solution.

4. The producing process of claim 1, wherein, in the step of loading stock solution in the first chamber, the stock solution is loaded so sufficiently that some stock solution overflow the first chamber to the second chamber.

5. A double dispensing container comprising:

a pressure vessel:

a dispensing valve mounted on a top opening of the vessel;

a pressure-transmittable barrier wall for separating an inside of the vessel with airtight manner into a first chamber to be loaded with stock solution and a second chamber to be loaded with pressurized gas;

a passage for connecting the valve with the first chamber; and a check valve means for enabling movement of gas from first chamber to the second chamber when pressure in the first chamber is higher than that of the second chamber and for preventing movement of gas from the second chamber to the first chamber when pressure in the second chamber is higher than that of the first chamber.

6. The double dispensing container of claim 5, wherein:

the barrier wall is a piston which separates the inside of the vessel and is slidable in up-down direction; and the piston is constructed so as to function as the check valve means for enabling gas movement from the first chamber to the second chamber and for preventing reverse movement.

7. The double dispensing container of claim 6, wherein:

the first chamber is placed at lower side of the piston; and the passage is a tube for connecting the valve with the first chamber.

8. A process for producing a dispensing device, by loading pressurized gas substantially insoluble to stock solution into the first chamber of the double dispensing container of claim 7 from the valve thereof; and loading stock solution into the first chamber from the valve through the tube with keeping the container in a standing posture upside down, to provide motion of the pressurized gas in the first chamber to the second chamber.

9. The double dispensing container of claim 6, wherein:

the first chamber is placed at upper side of the piston; and the valve is directly connected with the first chamber.

10. The double dispensing container of claim 6, wherein:

a periphery of the piston is yieldable elastically toward inside so that the piston can function as a check valve.

11. The double dispensing container of claim 6, wherein:

a stopper is interposed between the vessel and the piston so as to secure some space for the second chamber with a predetermined volume when the piston moves to decrease the volume of the second chamber.

12. The double dispensing container of claim 11, wherein:

the predetermined volume is 30 to 50% of the volume of the vessel.

13. The double dispensing container of claim 11, wherein:

the stopper is obtained by an inner face of the vessel to be abutted against the piston.

14. The double dispensing container of claim 11, wherein:

the stopper is obtained by a lower face of the valve to be abutted against the piston.

15. The double dispensing container of claim 6, further comprising a means for forcibly connecting the second chamber with the valve or the first chamber by deforming or piercing the piston, when the piston moves to reduce the volume of the first chamber.

16. The double dispensing container of claim 11, wherein:

a stopper is interposed between the valve and the piston so as to secure some space for the second chamber with a predetermined volume when the piston moves to decrease the volume of the second chamber.

17. The double dispensing container of claim 16, wherein:

the predetermined volume is 30 to 50% of the volume of the vessel.

18. The double dispensing container of claim 5, wherein:

the barrier wall is made of a collapsible or deformable inner bag of which inside becomes the first chamber; and the inner bag is provided with a check valve.

19. The double dispensing container of claim 18, wherein:

the check valve is placed at the bottom of the inner bag.

20. A process for producing a dispensing device, by loading pressurized gas substantially insoluble to stock solution into the inner bag from a valve of the double dispensing container of claim 19; and loading a stock solution into the inner bag from the valve with keeping the container in a standing posture upside down to provide motion of the pressurized gas remaining in the inner bag toward the second chamber between the pressure vessel and the inner bag.

21. The double dispensing container of claim 18, wherein:

the check valve is placed at top of the inner bag or at position near the dispensing valve.

22. The double dispensing container of claim 18, further comprising a forcibly connecting means for connecting an out side of the inner bag and an inner side of the inner bag or the valve by piercing the inner bag when the inner bag shrinks.

23. The double dispensing container of claim 5, further comprising a means for forcibly connecting the second chamber with the valve or the first chamber when the barrier wall moves or is deformed to reduce the volume of the first chamber.

* * * * *